United States Patent [19]

Hagihira

[11] 4,388,000

[45] Jun. 14, 1983

[54] ELECTRONIC APPARATUS HAVING A MUSICAL ALARM FUNCTION AND A DISPLAY

[75] Inventor: Touru Hagihira, Tokyo, Japan

[73] Assignee: Casio Computer Co., Ltd., Tokyo, Japan

[21] Appl. No.: 202,800

[22] Filed: Oct. 31, 1980

[30] Foreign Application Priority Data

Nov. 7, 1979 [JP] Japan ..... 54-153675[U]

[51] Int. Cl.[3] ..... G04C 21/00; G04C 19/00

[52] U.S. Cl. ..... 368/72; 368/82; 368/256; 368/273; 368/239; 84/477 R

[58] Field of Search ..... 368/72–75, 368/250–251, 256, 272, 273, 82–84, 239–242; 340/384 E; 84/1.01, 470, 477

[56] References Cited

U.S. PATENT DOCUMENTS

| | | | |
|---|---|---|---|
| 3,577,824 | 5/1971 | Lavan . | |
| 4,090,349 | 5/1978 | Takase | 340/384 E X |
| 4,202,235 | 5/1980 | Namiki et al. | 368/83 X |
| 4,213,372 | 7/1980 | Sasaki et al. | 84/470 R |
| 4,267,586 | 5/1981 | Uchino et al. | 368/73 |
| 4,307,645 | 12/1981 | Rauchi | 84/470 R X |

FOREIGN PATENT DOCUMENTS

| | | |
|---|---|---|
| 2403383 | 8/1974 | Fed. Rep. of Germany . |
| 1490502 | 8/1967 | France . |
| 2402262 | 3/1979 | France . |
| 1508557 | 4/1978 | United Kingdom . |
| 1523782 | 9/1978 | United Kingdom . |
| 1570162 | 6/1980 | United Kingdom . |
| 2035624 | 6/1980 | United Kingdom . |
| 2035664 | 6/1980 | United Kingdom . |

*Primary Examiner*—B. A. Reynolds
*Assistant Examiner*—Philip H. Leung
*Attorney, Agent, or Firm*—Frishauf, Holtz, Goodman & Woodward

[57] ABSTRACT

An electronic apparatus having a musical alarm function and a display, which produced a musical sound when an alarm time is reached while also concurrently performing score display of the musical notes of the produced musical sound on a printed five-line staff. The display produces a display of another function when the apparatus performs a function other than generation of the musical sounds.

4 Claims, 35 Drawing Figures

ELECTRONIC APPARATUS HAVING A MUSICAL ALARM FUNCTION AND A DISPLAY

BACKGROUND OF THE INVENTION

This invention relates to an electronic apparatus having a musical alarm function and a display.

Electronic apparatus having an alarm function such as electronic timepieces include those which provide music as an alarm sound.

If such an electronic timepiece effects concurrent display of the musical score of the musical sound being produced, the pleasure of following the displayed score with the eyes while hearing the music can be obtained, and also such an electronic apparatus can feature superior design.

To realize such an apparatus, it may be thought to print the score of the music that is provided on, for instance, a timepiece case. In this case, however, if the musical sound produced is long, a wide display area is required. In addition, the printed score is likely to fade away in color or vanish after long use of the apparatus.

The invention is intended in the light of the above, and its primary object is to provide an electronic apparatus having an alarm function, which can display the score of a musical sound produced as the alarm with an optical display means and hence requiring a small display area.

Another object of the invention is to provide such an electronic apparatus which can also make an effective display of working states concerning other functions with the aforementioned score display means.

SUMMARY OF THE INVENTION

To achieve the above objects, the electronic apparatus having an alarm function according to the invention has a construction comprising a time counting means for supplying time information through the counting of a reference clock signal, a musical sound generating means for a producing musical sound when the time information supplied from the time counting means coincides with an alarm time, a plurality of optical musical note display elements provided on the lines and spaces of a five-line musical staff, and a musical note display control means for selectively driving the plurality of optical musical note display elements such that the notes of the musical sound produced by the musical sound generating means are concurrently displayed.

Thus, according to the invention it is possible to provide an electronic apparatus having an alarm function, which can display the score of music produced as the alarm sound with a small display area and also add interest to the otherwise somewhat monotonous time display.

This invention can be more fully understood from the following detailed description when taken in conjunction with the accompanying drawings.

DETAILED DESCRIPTION

Figure 1A:
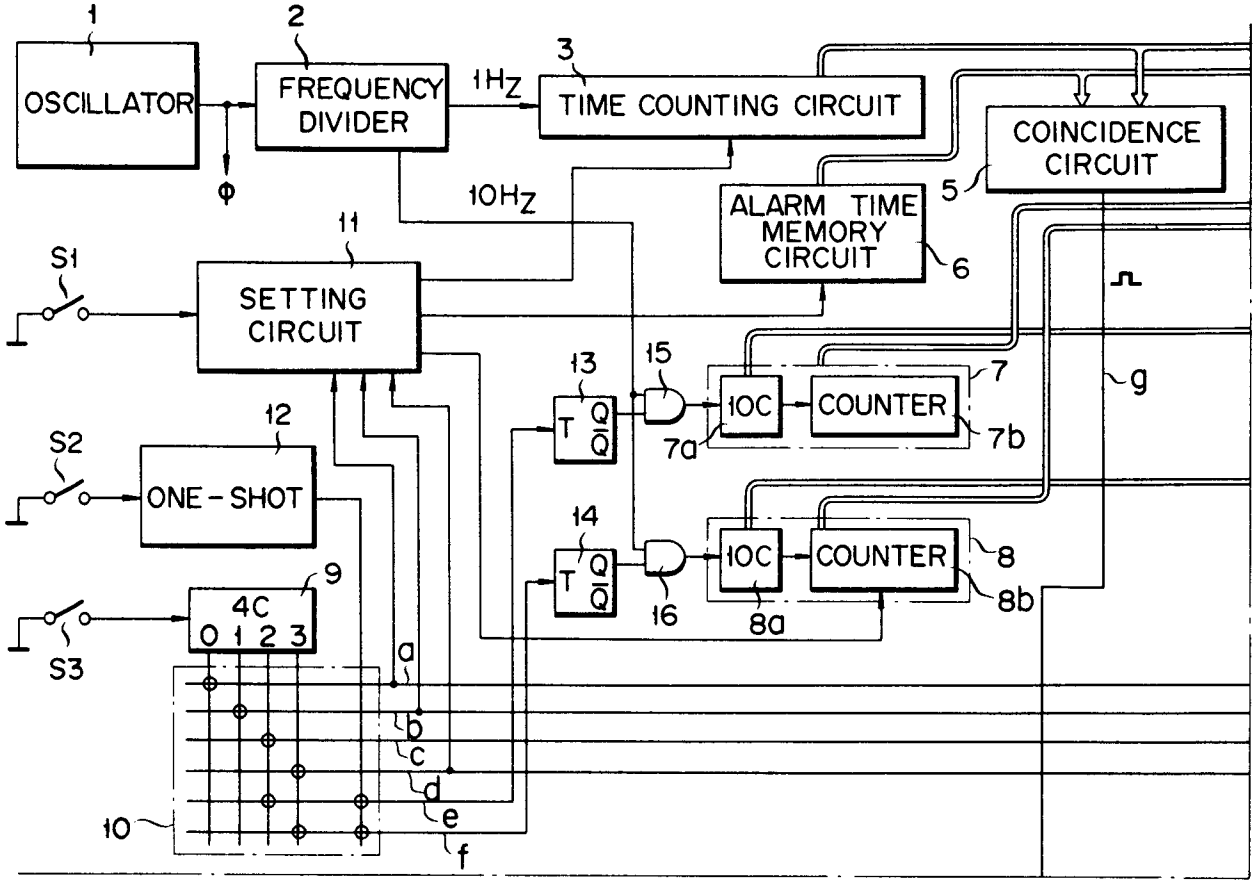
FIGS. 1A to 1C is a schematic representation of the circuit construction of an electronic timepiece embodying the invention.
Figure 1B:
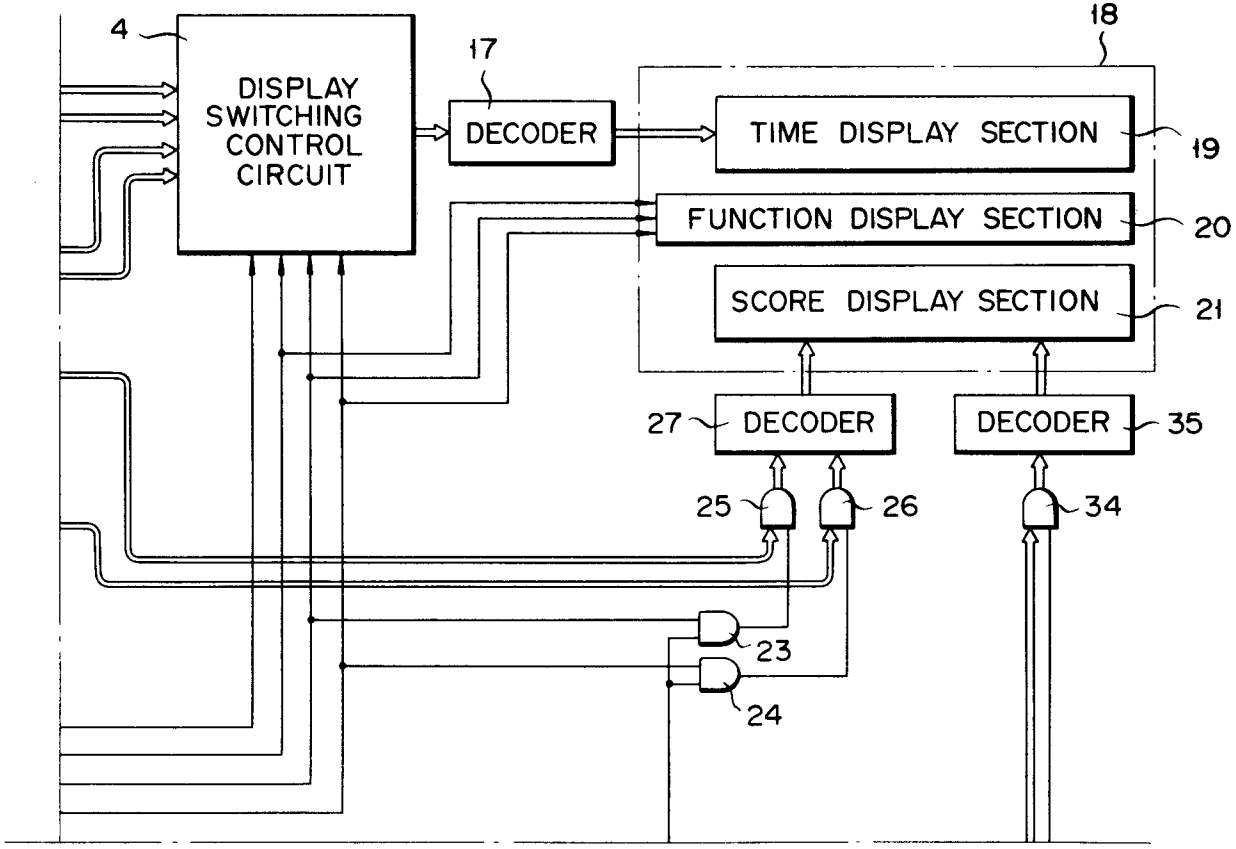
Figure 1C:
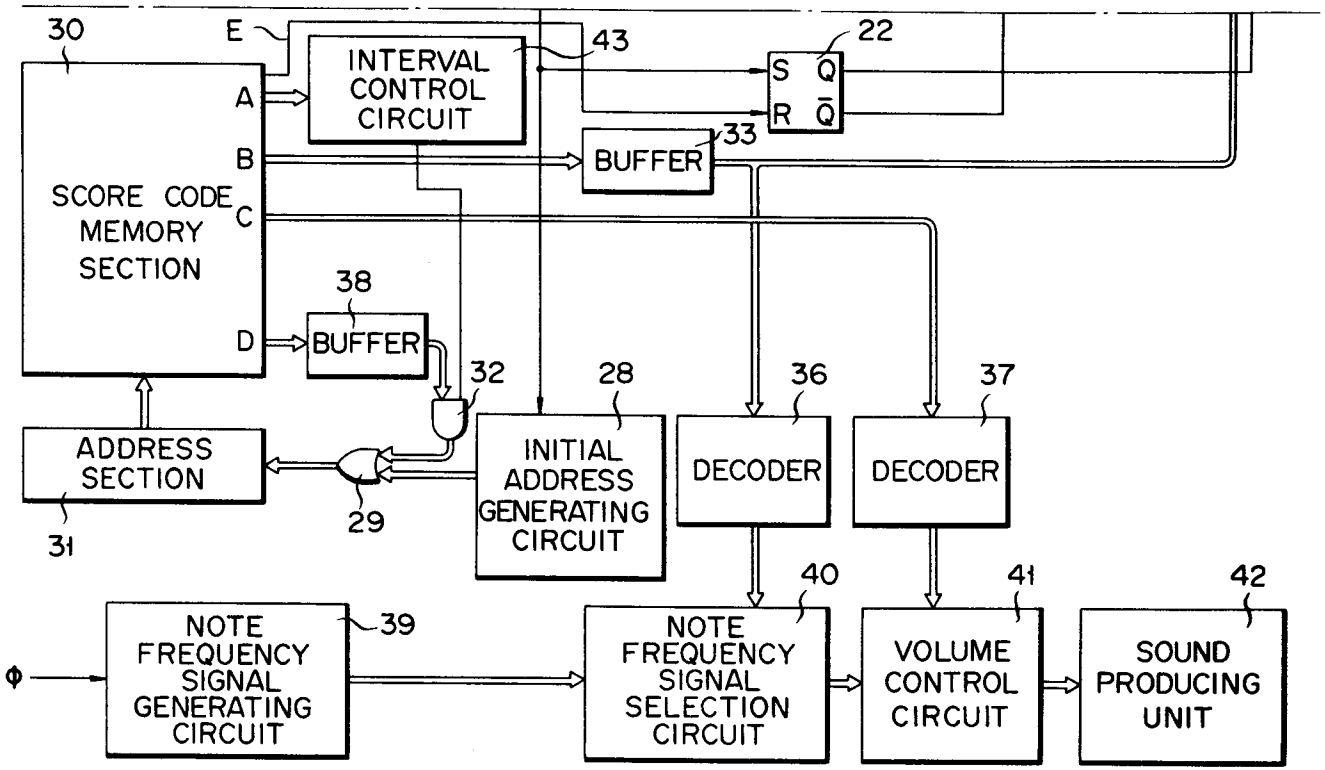
Figure 2:
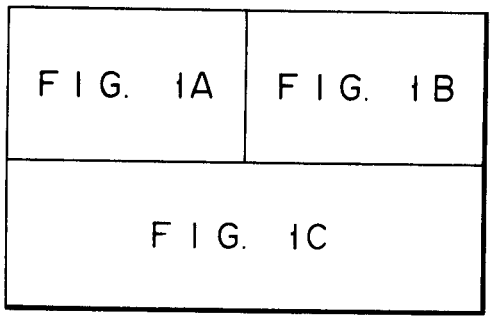
FIG. 2 is a view showing the layout of FIGS. 1A to 1C.

FIGS. 1A to 1C show the circuit construction of the embodiment of the invention applied to an electronic timepiece, and FIG. 2 is a layout of FIGS. 1A to 1C. Designated at 1 is an oscillator for producing a reference frequency signal which is supplied to a frequency divider 2. The frequency divider 2 divides the input signal to produce a one-second period signal which is supplied to a time counting circuit 3. The time counting circuit 3 counts "seconds", "minutes" and "hours" on the basis of the input one-second period signal, and its time count information thus obtained is coupled to a display switching control circuit 4 and a coincidence circuit 5. Alarm time data set in an alarm time memory circuit 6 is also supplied to the display switching control circuit 4 and coincidence circuit 5. The coincidence circuit 5 produces a one-shot pulse coincidence signal g when it detects the coincidence of the time information from the time counting circuit 3 and the time data provided from the alarm time memory circuit 6. To the display switching control circuit 4 are also supplied information from a stopwatch circuit 7 and an information from a down-counting timer circuit 8. Designated at $S_1$ is an alarm time setting switch, at $S_2$ a start/stop switch for the stopwatch circuit 7 and down-counting timer circuit 8, and at $S_3$ is a function selection switch. The signal produced from the function selection switch $S_3$ when this switch is operated is coupled to a four scale of counter 9, the content of which is progressively shifted according to its input. The progressive count value signals from the counter 9 are coupled to a function selection circuit 10.

The function selection circuit 10 produces function selection signals a to d corresponding to the respective count value signals from the counter 9. These function selection signals are coupled to the display switching control circuit 4, and also the function selection signals a, b and d are coupled to a setting circuit 11. When the function selection signal a is being supplied from the function selection circuit 10 to the setting circuit 11, the function selection circuit 10 is permitted to supply present time information. When the function selection signal b is being supplied, an alarm time can be set in the alarm time memory circuit $S_1$ by operating the setting switch $S_1$. Further, when the function selection signal d is being supplied, a timer time can be set in the down-counting timer circuit 8 by operating the setting switch $S_1$. A one-shot circuit 12 produces a one-shot signal when a start/stop switch $S_2$ is operated. When the one-shot signal is supplied from the one-shot circuit 12 in the presence of the signal of the count value "2" supplied from the counter 9, the function selection circuit 10 supplies the output signal e, which is supplied as the operation control signal with respect to the stopwatch circuit 7 to an input terminal T of a binary flip-flop 13. When the one-shot signal is supplied from the one-shot circuit 12 in the presence of the signal of count value "3" from the counter 9, the output signal f is supplied to be coupled as the operation control signal with respect to the down-counting timer circuit 8 to an input terminal of the binary flip-flop 14. The Q side output signal from the flip-flop 14 is coupled as gate control signal to one of input terminals of the AND gate 15, which receives at its other input terminal a 10-Hz signal from the frequency divider 2. The 10-Hz signal coupled through the AND gate 15 goes to a decimal up-counter 7*a* in the stopwatch circuit 7. The decimal up-counter 7*a* provides 1/10 second unit time information on the basis of the 1/10-Hz signal, and its carrier signal output is coupled to a counter 7*b* in the stopwatch circuit 7, which provides time information of one second or and higher units. The Q side output signal from the binary flip-flop 14 is coupled as gate control signal to one of input terminals of the AND gate 16, which receives at its other input terminal the aforementioned 10-Hz signal from the frequency divider 2. The 10-Hz signal coupled through the AND gate 16 goes to a decimal down-counter 8*a* provides 1/10 second unit time information on the basis of the 1/10-Hz signal, and its borrow signal output is coupled to a counter 8*b* in the down-counting timer circuit 8, which provides time information of one second and higher units through down-counting.

The display switching control circuit 4 selectively couples the data from the time counting circuit 3, alarm time memory circuit 6, stopwatch circuit 7 and down-counting timer circuit 8 to a decoder 17 and thence to a time display section 19 in a liquid crystal display unit 18 according to the function selection signals a to d supplied from the function selection circuit 10. The liquid crystal display unit 18 includes, in addition to the time display section 19, a function display section 20 and a score display section 21. The function selection signals b, c and d supplied from the function selection circuit 10 are also coupled to the function display section 20.

The coincidence signal g produced from the coincidence circuit 5 is coupled to a set input terminal of a flip-flop 22. The $\overline{Q}$ side output signal from the flip-flop 22 is supplied as gate control signal to an AND gate 23, which receives the function selection signals c at its other input terminal, and also to an AND gate 24, which receives the function selection signal d at its other input terminal. The output signal of the AND gate 23 is supplied as gate control signal to one of input terminals of an AND gate 25, and the output signal of the AND gate 24 is supplied as gate control signal to one of input terminals of an AND gate 26. To the other input terminal of the AND gate 25 is supplied the time information from the decimal up-counter 7*a* in the stopwatch circuit 7, and to the other input terminal of the AND gate is supplied time information from the decimal down-counter 8*a* in the down-counting timer circuit 8. The outputs of the AND gates 25 and 26 are coupled through a decoder 27 to the score display section 21.

The coincidence signal g supplied from the coincidence circuit 5 is also coupled to an initial address generating circuit 28. The output of the initial address generating circuit 28 is coupled through an OR gate 29 to an address section 31 for specifying address in a score code memory section 30. The score code memory section 30 is constituted by, for instance, a read-only memory (ROM), in which various codes representing in combination a piece of music are memorized. When an address in the memory section 30 is specified from the address section 31, an interval code A, a note code B and a volume code C in this address and an address specification signal D for specifying the next address are supplied as simultaneous data from the memory section 30. The interval code A is coupled to an interval control section 43, which supplies an output signal as gate control signal to one of input terminals of an AND gate 32 when a predetermined period corresponding to the input interval code A has been elapsed. The note code B is stored once in a buffer 33 and then coupled to one of input terminals of an AND gate 34, to the other input terminal of which the Q side output signal from the flip-flop 22 is supplied as gate control signal. The output data from the AND gate 34 is coupled through a decoder 35 to the score display section 21. The note code B stored in the buffer 33 is also coupled to a decoder 36, and the volume code C is coupled to a decoder 37. The next address specification signal D is stored once in a buffer 38 and then coupled through the other input terminal of the AND gate 32 and the OR gate 29 to the address section 31. When the piece of music is ended, the score code memory section 30 supplies an end signal E, which is coupled to a reset input terminal R of the flip-flop 22.

The reference frequency signal $\phi$ from the oscillator 1 is also supplied to a note frequency signal generating circuit 39, which divides the input reference frequency signal $\phi$ to produce clock signals at frequencies corresponding to respective musical notes such as A, B and C. These clock signals are supplied to a note frequency signal selection circuit 40, which selectively couples a clock signal corresponding to a note represented by the content of the decoder 36 to a volume control circuit 41. The volume control circuit 41 effects the volume control of the clock signal coupled from the note frequency signal selection circuit 40 according to the output of the decoder 37. A sound producing unit 42 produces predetermined musical sound as alarm sound according to the output signal from the volume control circuit 41.

Figure 3:
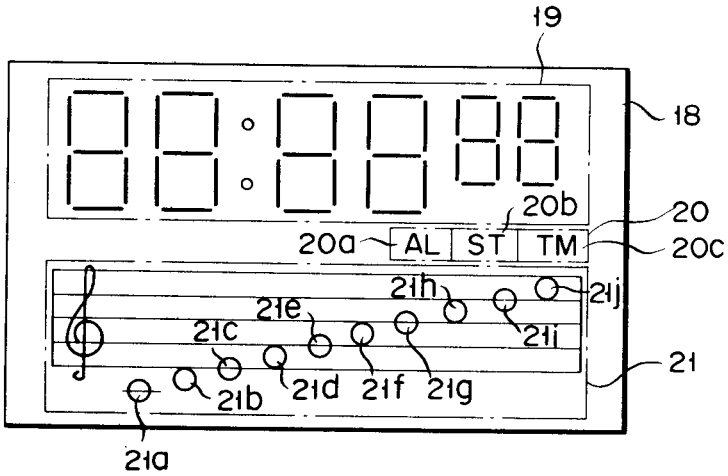
FIG. 3 is a view showing a liquid crystal display unit shown in FIG. 1B.
Figure 4:
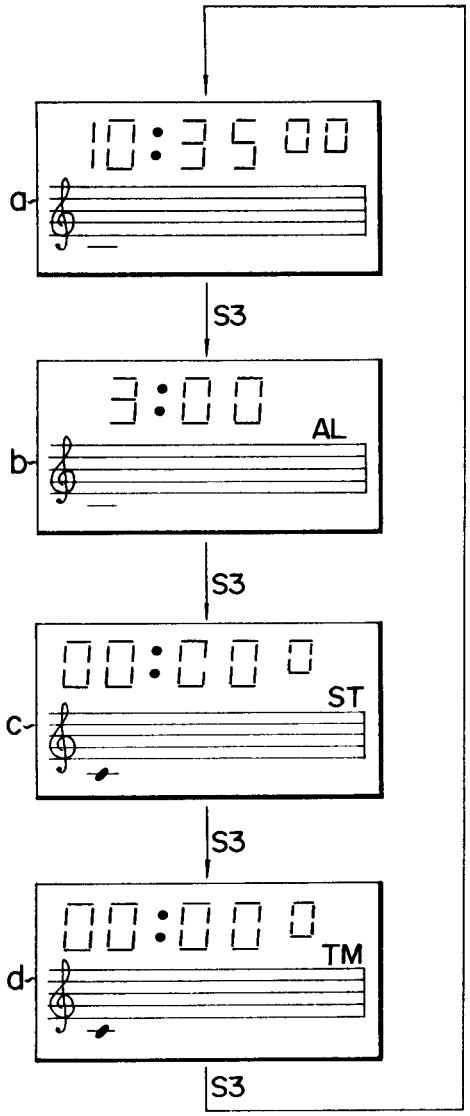
FIG. 4 shows various display states of liquid crystal display unit 18 when corresponding functions are selected.

FIG. 3 is a detailed view of the liquid crystal display unit 18 shown in FIG. 1B. In the time display section 19, data coupled from the display switching control circuit 4 is digitally displayed with corresponding driving of six figure-eight-shaped display digits. In the function display section 20, an AL display element 20*a* for indicating an alarm function display mode, an ST display element 20*b* for indicating a stopwatch function display mode and a TM display element 20*c* for indicating a down-counting timer function display mode are provided. In the score display section 21, a five-line staff and a G clef are provided by means of printing on the surface of a top plate of the liquid crystal display unit 18, and ten note display elements 21*a* to 21*j* for displaying respective notes are provided within the top plate on the lines and spaces on the staff.

Now, the operation of the electronic timepiece having the above construction will be described with reference to FIGS. 4 through 7. Usually, the flip-flop 22 is supplying its $\overline{Q}$ side output signal, and the content of the four scale of counter 9 is "0". In this state, the function selection signal a is being supplied from the function selection circuit 10 to the display switching control circuit 4. Thus, the time information obtained from the time counting circuit 3 is coupled through the display switching control circuit 4 to the time display section 19, so that the present time, for instance "10:35 00" is displayed as shown in (a) in FIG. 4.

When the function selection switch $S_3$ is operated, the content of the four scale of counter 9 is changed to the next upper count value "1". As a result, the function selection circuit 10 supplies the function selection signal b, so that the display switching control circuit 4 couples the alarm time data from the alarm time memory circuit 6 to the time display section 19. Thus, in the time display section 19 the alarm time data, for instance "3:00", is displayed as shown in (b) in FIG. 4. At the same time, the function selection signal b is also coupled to the function display section 20. Thus, the AL display element 20*a* is driven to indicate that the display unit 18 is in the alarm time display mode.

When the function selection switch $S_3$ is operated in this state, the content of the four scale of counter 9 is changed to the next value "2". As a result, the function selection circuit 10 supplies the function selection signal c, so that the display switching control circuit 4 couples the data from the stopwatch circuit 7 to the time display section 19. Thus, in the time display section 19 the initial value of the stopwatch information, namely "00:00 00", is displayed as shown in (c) in FIG. 4. At the same time, the function selection signal c is also coupled to the function display section 20. Thus, the ST display element 20*b* is driven to indicate that the display unit 18 is in the stopwatch time display mode. The function selection signal c is further coupled to the AND gate 23, so that an output is produced therefrom to open the AND gate 25. Thus, the count value of the decimal up-counter 7*a* in the stopwatch circuit 7 is coupled through the AND gate 25 and decoder 27 to the score display section 21, so that in the score display section 21 the note display element 21*a* corresponding to C in the scale is driven to display the note C as shown in (c) in FIG. 4.

When the function selection switch $S_3$ is operated in this state, the content of the four scale of counter 9 is changed to the next value "3". As a result, the function selection circuit 10 supplies the function selection signal d, so that the display switching control circuit 4 couples the data from the down-counting timer circuit 8 to the time display section 19. Thus, in the time display section 19 the time data before the setting of the timer time, namely "00:00 00", is displayed as shown in (d) in FIG. 4. At the same time, the function selection signal d is also coupled to the function display section 20. Thus, the TM display element 20*c* is driven to indicate that the display unit 18 is in the timer time display mode. The function selection signal d is further coupled to the AND gate 24, so that an output is produced therefrom to open the AND gate 26. Thus, the count value of the decimal down-counter 8*a* is coupled through the AND gate 26 and decoder 27 to the score display section 21, so that in the score display section 21 the note display element 21*a* corresponding to C in the scale is driven to display the note C as shown in (d) in FIG. 4.

In the ordinary time display state, when the coincidence circuit 5 detects the alarm time set in the alarm time memory circuit 6, for instance "3:00", it produces the detection signal g to set the flip-flop 22. As a result, the flip-flop 22 is inverted, so that its Q side output signal is supplied to the AND gate 34. The coincidence detection signal g is also coupled to the initial address generating circuit 28, whereupon the initial address generating circuit 28 produces initial address data which is coupled through the OR gate 29 to the address section 31. The address section 31 specifies an address in the musical code memory section 30 corresponding to the input address data. With the initial address specified, the musical code memory section 30 supplies an interval code A, a note code B and a volume code C for the first one of the notes forming a piece of music, for instance C note, as well as a code specifying the next address as simultaneous data. The note code B is coupled through the buffer 33 to the decoder 36, while the volume code C is coupled to the decoder 37. At this time, the note frequency signal selection circuit 40 selectively couples one of the clock signals from the note frequency signal generating section 39 corresponding to the content of the decoder 36 to the volume control circuit 41, and the volume control circuit 41 effects volume control according to the content of the decoder 37. The output of the circuit 41 is coupled to the sound producing unit 42. Thus, the sound producing unit 42 produces the sound of the first note C of the music at a predetermined volume level. This sound of the first note C is produced until a predetermined time interval corresponding to the volume code C is elapsed. Meanwhile, the content of the buffer 33 is coupled through the AND gate 34 to the decoder 35 for decoding, and the output thereof is coupled to the score display section 21. In the score display section 21, one of the note display elements 21*a* to 21*j* corresponding to the input note code, namely element 21*c*, is selectively driven, so that the note C is displayed as shown in (a) in FIG. 5. When the interval control circuit 43 subsequently produces an output, the AND gate 32 is opened, so that the next address specification signal D is coupled through the buffer 38 to the address section 31. Thus, the prevailing address in the score code memory section 30 is switched over to the next one according to the address specification data from the address section 31, so that the interval code A, note code B and volume code C for the second note of the music piece as well as the next address specification signal D are supplied as simultaneous data. Thus, the sound producing unit 42 produces the sound of the note corresponding to the note code B, for instance E, at a volume level corresponding to the volume code C. Also, in the score display section 21, the note C of this sound is displayed as shown in (b) in FIG. 5.

Figure 5:
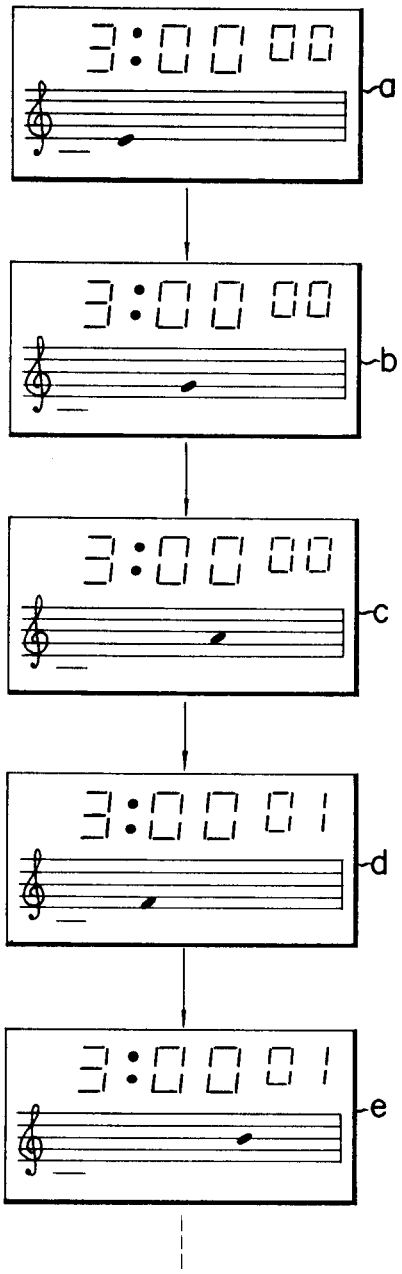
FIG. 5 shows display states of the liquid crystal display unit 18 at the time when an alarm sound is being produced.

In the above way, the successive notes of the produced musical sound, for instance F, D and G, are displayed as shown in (c) through (e) in FIG. 5.

Figure 6:
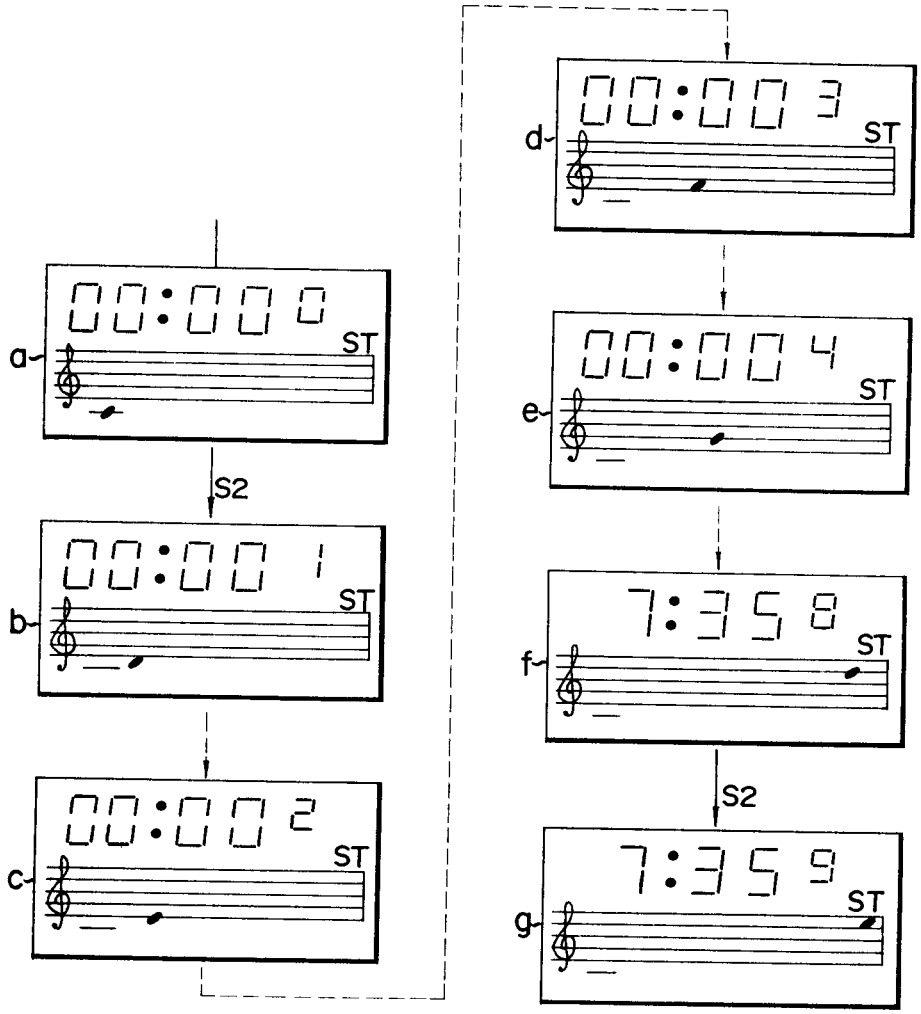
FIG. 6 shows display states of the liquid crystal display unit 18 in a stopwatch function display mode.

When the content of the four scale of counter 9 is set to "2" with the operation of the function selection switch $S_3$, display of the note A in the score display section 21 is obtained as well as the display of the initial value "00:00 00" of the stopwatch information in the time display section 19 as shown in (a) in FIG. 6. In this state, by operating the start/stop switch $S_2$ the output signal e is supplied from the function selection circuit 10, thus causing the binary flip-flop 13 to produce the Q side output signal which is coupled to the AND gate 15. As a result, the 10-Hz signal is supplied through the AND gate 15 to render the decimal up-counter 7*a* in the stopwatch circuit 7 operative. Thus, the decimal up-counter 7*a* is caused to up-count the 10-Hz signal, i.e., 1/10 second signal, and the counter 7*b* is caused to up-count the carry signal from the up-counter 7*a*. With this up-counting, the display in the time display section 19 is successively changed for every 1/10 second as shown in (a) through (g) in FIG. 6. Concurrently with this time display change, in the score display section 21 the score display is changed for every 1/10 second according to the content of the decimal up-counter 7*a*. More particularly, when the time display is changed to "00:00 1", the note display element 21*b* is driven to display the note B, when the time display is changed to "00:00 2" the note display element 21*c* is driven to display the note C, when the time display is changed to "00:00 3" the note display element 21*d* is driven to display the note D, and so on. By subsequently operating the start/stop switch $S_2$ again, the binary flip-flop 13 is inverted to close the AND gate 15. Thus, the display at this instant, for instance as shown in (g) in FIG. 6, is held without any subsequent change.

Figure 7:
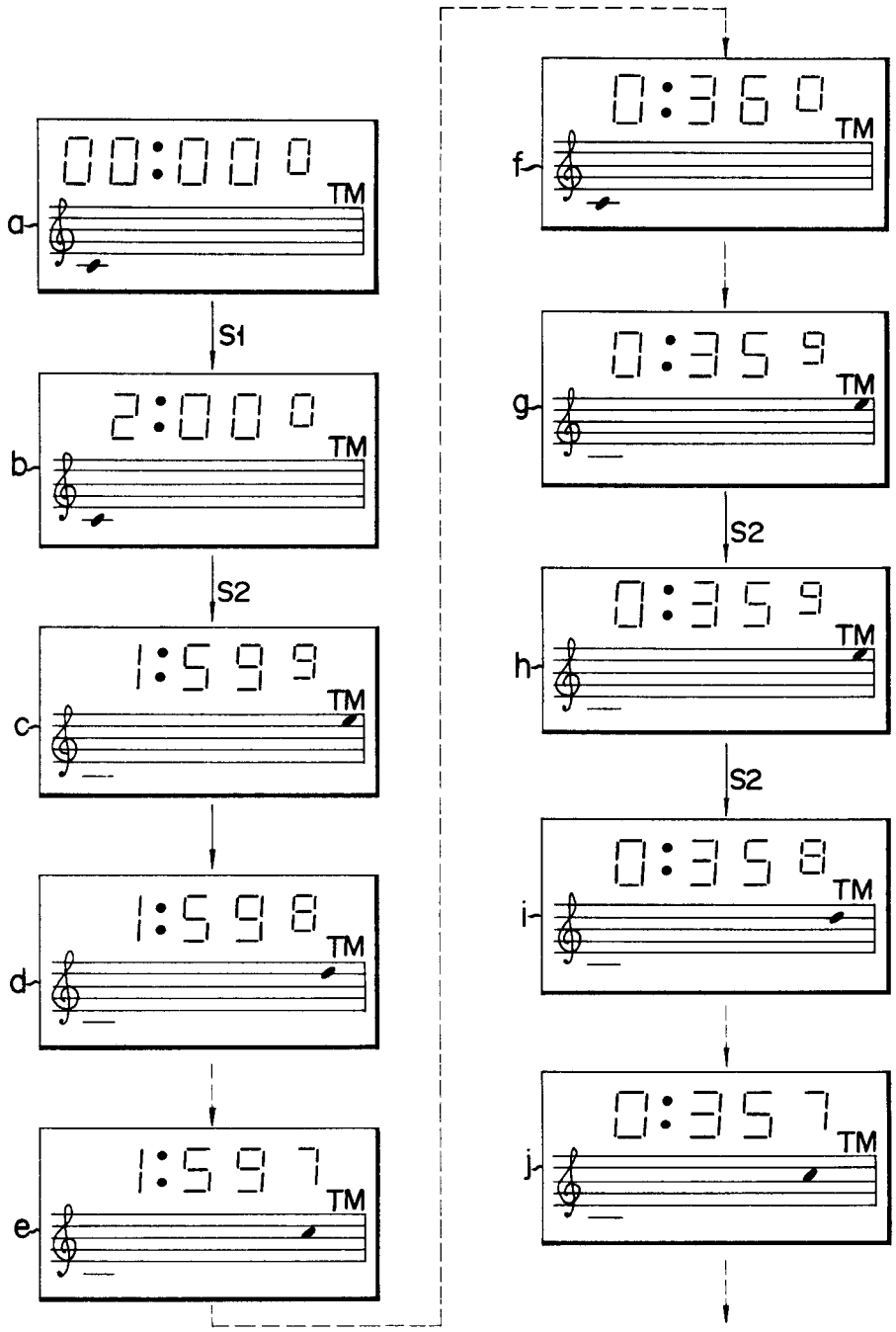
FIG. 7 shows display states of the liquid crystal display unit 18 in a timer function display mode.

When the content of the four scale of counter 9 is set to "3" with the operation of the function selection switch $S_3$ in the manner as described above, display of the note A in the score display section 21 is again obtained as well as the display of the data "00:00 0" before the setting of the timer time in the time display section as shown in (a) in FIG. 7. In this state, the function selection signal d is supplied from the function selection circuit 10 to the setting circuit 11, so that a timer time can be set in the down-counting timer circuit 8 with the operation of the setting switch $S_1$. The timer time set in the down-counting timer circuit 8, for instance "2:00 0", is displayed as shown in (b) in FIG. 7. In this state, by operating the start/stop switch $S_2$, the output thereof is coupled through the one-shot circuit 12 to the function selection circuit 10. As a result, the function selection circuit 10 supplies the output signal f, so that the binary flip-flop 14 produces the Q side output signal. Thus, the AND gate 16 is opened to couple the 10-Hz signal to the decimal down-counter 8*a* in the down-counting timer circuit 8, so that the down-counter 8*a* is caused to successively down-count its content for every 1/10 second according to the input 10-Hz signal, and the counter 8*b* is caused to down-count its preset timer time data "2:00 0" for every 1 second according to the borrow signal produced from the decimal down-counter 8*a*. With this down-counting, the display in the time display section is successively changed to "1:59 8", "1:59 7", . . . , "0:35 9" for every 1/10 second as shown in (c) through (g) in FIG. 7. Concurrently with this time display change, in the score display section 21 the score display is changed for every 1/10 second according to the content of the decimal down-counter 8*a*. More particularly, when the timer time display is changed to "1:59 9" the note display element 21*j* is driven to display one octave higher C in as shown in (c) in FIG. 7, when the timer time display is changed to "1:59 8" the note display element 21*i* is driven to display B in that octave as shown in (d) in FIG. 7, when the timer time display is changed to "1:59 7" the note display element 21*h* is driven to display A in that octave, and so on.

When the start/stop switch $S_2$ is operated again, the output thereof is coupled this time as stop instruction signal through the one-shot circuit 12 to the function selection circuit 10. As a result, the function selection circuit 10 produces the output signal f to invert the binary flip-flop 14 for closing the AND gate 16. Thus, the content of the down-counting timer circuit 8 at this instant is held without any subsequent change, that is, the time display "0:35 9" in the time display section 19 and the display of one octave higher C in the score display section 21, as shown in (h) in FIG. 7, are held unchanged. By further operating the start/stop switch $S_2$ in this state, the function selection circuit 10 again supplies the output signal f. As a result, the binary flip-flop 14 is inverted once again to open the AND gate 16, so that the operation of the down-counting timer circuit 8 is resumed again, causing successive changes of the time and score displays as shown in (i) and (j) in FIG. 7.

As has been shown, according to the invention the score display is controlled such that it is shifted with the progressive renewal of the counter values of the stopwatch and timer functions, it is possible to provide a sort of lively motion of the display and make-up for the monotonousness thereof. Also, since the score display regarding the timer function and that regarding the stopwatch function can be clearly distinguished from each other, because the former display is shifted from the right top to the left bottom of the display area as shown in FIG. 7 while the latter display is shifted from the left bottom to the right top as shown in FIG. 6.

Figure 8:
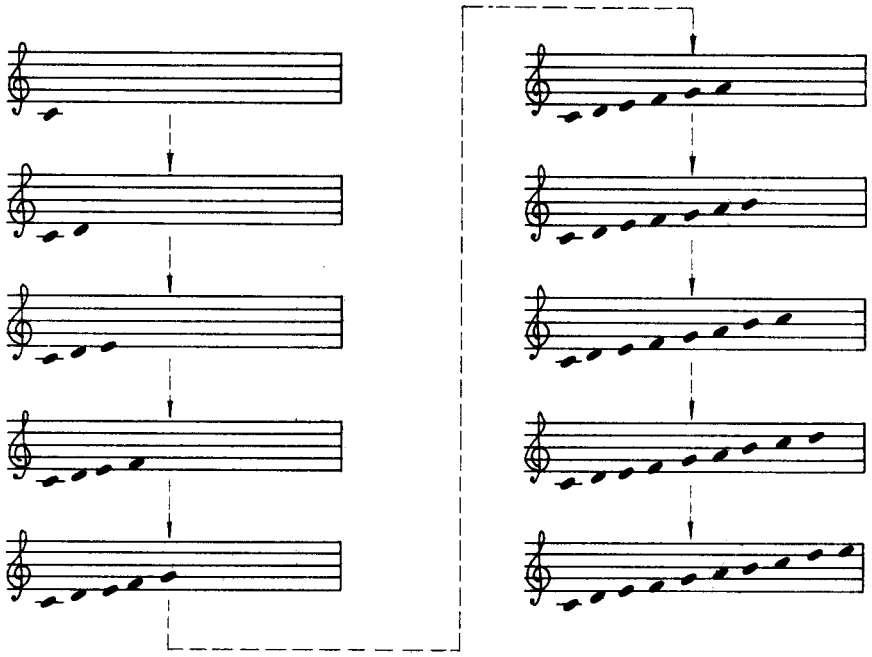
FIG. 8 shows display states of score display section 21 in a modification of the embodiment of FIGS. 1A through 1C in the stopwatch function display mode.
Figure 9:
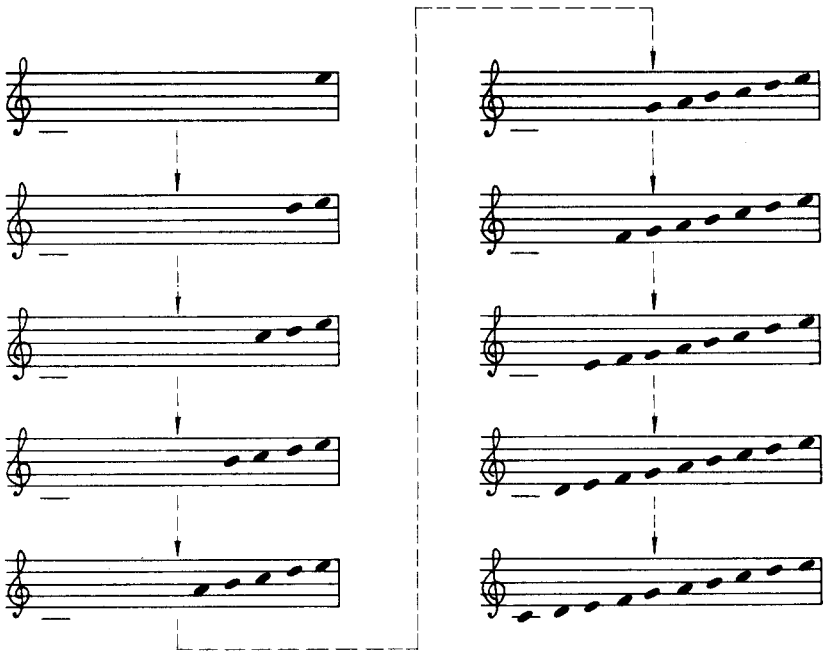
FIG. 9 shows display states of the score display section 21 in the same modification in the timer function display mode.

FIGS. 8 and 9 show displays regarding the stopwatch and timer functions in a modification of the preceding embodiment. While in the preceding embodiment every time the counter value regarding the stopwatch function is renewed the previous display is turned off to display only a single note, in this example every time the counter value is renewed the corresponding note display is added without erasing the previous note display so that the displayed notes are progressively increased from the left bottom toward the right top of the display area. Also, the note display regarding the timer function is increased from the right top toward the left bottom every time the timer function counter value is renewed.

Figure 10:
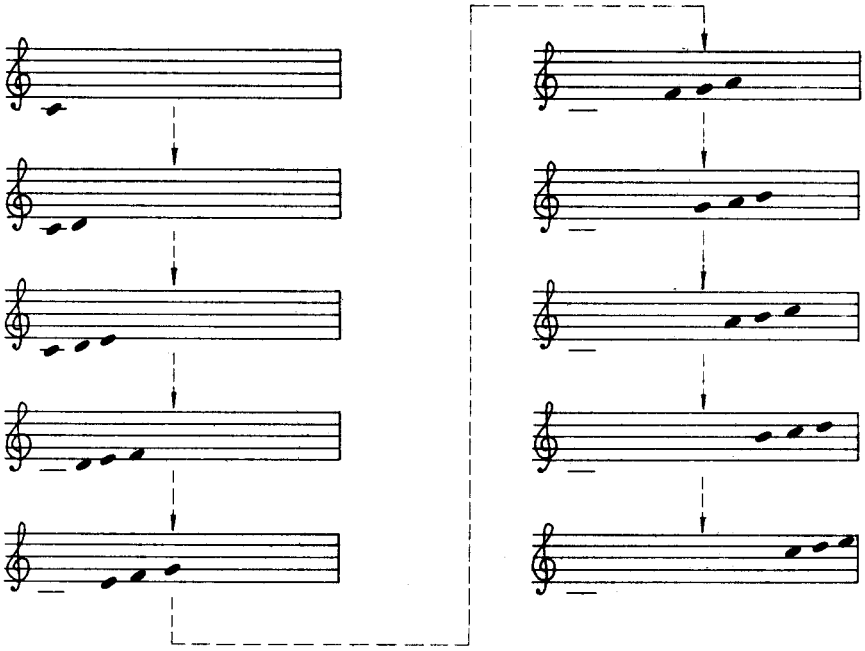
FIG. 10 shows display states of score display section 21 in a second modification of the embodiment of FIGS. 1A through 1C in the stopwatch function display mode.
Figure 11:
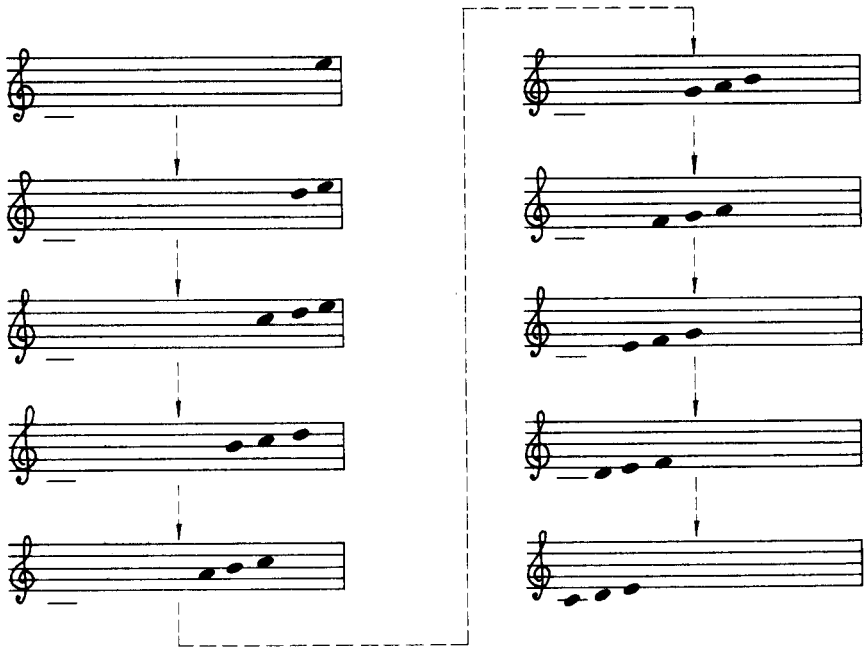
FIG. 11 shows display states of the score display section 21 in the second modification in the timer function display mode.

FIGS. 10 and 11 show displays regarding the stopwatch and timer functions in another modification of the previous embodiment. In this example, in the case of the stopwatch function, one note is displayed at the time of the first renewal of the counter value, two notes are displayed at the time of the second renewal, and three notes are displayed at every subsequent renewal time, the display being shifted from the left bottom to the right top of the display area. In the case of the timer function, similar display, i.e., one note at the time of the first counter value renewal, two notes at the time of the second renewal and three notes at every subsequent renewal time, is obtained, the display in this case however being shifted from the right top to the left bottom.

While in the above embodiment the counter values regarding the stopwatch and timer functions are adapted to be displayed in the score display section, it is also possible to display the ordinary time information such as second unit time information or weekday unit time information with the note display elements in the score display section.

Further, while in the above embodiment the five-line staff and G clef are printed on the surface of the top plate of the liquid crystal display unit 18, it is possible to optically display them with a separate liquid crystal display unit which may, for instance, be provided under the arrangement of the note display elements 21*a* to 21*j*.

Furthermore, while the above embodiment has been applied to an electronic timepiece, this is by no means limitative, and the invention may be applied to any electronic apparatus having an alarm function such as an electronic computer having a timepiece function.

What is claimed is:

1. An electronic apparatus having a musical alarm function, a function other than said musical alarm function and a display, comprising:

a source of reference clock signals;

time counting means for counting said reference clock signals to form time data;

means for generating alarm time data;

time display means coupled to said time counting means for displaying said time data;

alarm function circuit means coupled to said time counting means and to said alarm time data generating means, said alarm function circuit means including:

alarm time detection means for determining whether said time data coincides with alarm time data;

note code memory means for storing note codes for a melody;

note code readout means coupled to said note code memory means for sequentially reading out said note codes from said note code memory means when said time data is determined to coincide with said alarm time; and melody generating means coupled to said note code readout means for generating a melody according to said readout note codes;

a plurality of optical display elements provided on and between lines of the five-line musical staff;

scale display control means coupled to said optical display elements for selectively driving said optical display elements to display the notes of said melody when said melody is generated by said melody generating means; and function display control means coupled to said optical display elements for selectively driving said optical display elements to produce a display of said function other than said musical alarm function which the apparatus performs when said melody is not generated.

2. The electronic apparatus of claim 1, wherein said function display control means causes said plurality of optical display elements to display part of the time data supplied from said time counting means during said other function when said melody is not produced.

3. The electronic apparatus of claim 1, wherein said function other than said music alarm function is a stopwatch function, and further comprising stopwatch circuit means including:

means for generating start and stop instructions;

a stopwatch counter means for starting the counting of a predetermined frequency signal responsive to a start instruction and for stopping the counting of said predetermined frequency signal responsive to a stop instruction; and means for successively shifting the display obtained through said selective driving of said plurality of optical display elements by said function display control means every time the count value provided by said stopwatch counter means is renewed.

4. The electronic apparatus of claim 1, wherein said function other than said music alarm function is a timer function, and further comprising:

means for supplying a signal of a predetermined period;

circuit means including a timer down-counter means for down-counting a preset value every time said signal of a predetermined period is supplied; and means for successively shifting the display obtained through said selective driving of said plurality of optical display elements by said function display control means every time the count value provided by said timer down-counter means is renewed.

* * * * *